US012428815B1

(12) United States Patent
Ma et al.

(10) Patent No.: US 12,428,815 B1
(45) Date of Patent: Sep. 30, 2025

(54) SWING PUMP CONTROLS

(71) Applicant: Progress Rail Locomotive Inc., LaGrange, IL (US)

(72) Inventors: Pengfei Ma, Naperville, IL (US); Brett James Janson, Hanna City, IL (US); Tonglin Shang, Bolingtbrook, IL (US); Sean Wesley Johnson, Tucson, AZ (US)

(73) Assignee: Progress Rail Locomotive Inc., LaGrange, IL (US)

( * ) Notice: Subject to any disclaimer, the term of this patent is extended or adjusted under 35 U.S.C. 154(b) by 0 days.

(21) Appl. No.: 18/798,536

(22) Filed: Aug. 8, 2024

(51) Int. Cl.
*E02F 9/22* (2006.01)

(52) U.S. Cl.
CPC ..... *E02F 9/2242* (2013.01); *E02F 9/2292* (2013.01)

(58) Field of Classification Search
CPC ..... E02F 9/2228; E02F 9/2292; E02F 9/2242
See application file for complete search history.

(56) References Cited

U.S. PATENT DOCUMENTS

| | | | | |
|---|---|---|---|---|
| 8,192,175 | B2 | 6/2012 | Kuttler et al. | |
| 8,206,125 | B2 | 6/2012 | Kuttler et al. | |
| 10,385,892 | B2 | 8/2019 | Cugati et al. | |
| 11,111,651 | B2 * | 9/2021 | Shimizu | F15B 11/17 |

FOREIGN PATENT DOCUMENTS

| | | | | |
|---|---|---|---|---|
| CN | 103486098 A | | 1/2014 | |
| GB | 2608192 A | * | 12/2022 | E02F 9/2228 |

* cited by examiner

*Primary Examiner* — Abiy Teka
(74) *Attorney, Agent, or Firm* — Lee & Hayes, PLLC

(57) ABSTRACT

Systems and method for operating a hydraulic swing system are described herein. The hydraulic swing system may include a first hydraulic pump and a second hydraulic pump in fluid communication with one another. A first hydraulic motor configured to drive rotation of the hydraulic swing system and may be in fluid communication with the first hydraulic pump and the second hydraulic pump. A controller configured to increase a rate of rotation of the hydraulic swing system in a first direction by: engaging the first hydraulic pump to provide a hydraulic fluid through the first hydraulic path to the first hydraulic motor to drive rotation of the hydraulic swing system; and engaging the second hydraulic pump to provide hydraulic fluid through the first hydraulic path to the first hydraulic motor to drive rotation of the hydraulic swing system.

19 Claims, 6 Drawing Sheets

SWING PUMP CONTROLS

TECHNICAL FIELD

The present application relates generally to hydraulic systems and machinery, and more particularly to a hydraulic swing system for a vehicle or machine that includes systems and methods for operating multiple swing pumps.

BACKGROUND

Excavators and other machines often have hydraulically-controlled components. For example, a hydraulic pump linked to hydraulic cylinders can actuate a boom, stick, and/or bucket of an excavator. Conventionally, hydraulic components are often directly controlled mechanically. For example, in conventional mechanical control, movement of a lever can mechanically open or close a hydraulic valve to change the pressure in a hydraulic cylinder and thereby cause movement of a machine component. More recently, machines have been developed that translate inputs into electric currents or signals that drive actuation of the hydraulic components. For example, the velocity, accelerations, or rate of rotation of the machine may be controlled by an operator as opposed to directly controlling the hydraulic components to move the machine components.

The addition of providing for direct control of the machine components introduces inefficiencies or flaws within conventional hydraulic systems. For example, traditional systems may use a plurality of swing pumps acting in concert to provide fluid to the hydraulic cylinder to move machine components. However, by directly controlling the acceleration or rate of rotation of a component, such the traditional system may introduce inconsistent and sudden movements as a response to the user inputs. In other words, the user inputs may call for an increase in velocity or rate of rotation which would engage each of the pumps, resulting in a sharp or unpredictable increase in flowrate and pressure within the hydraulic system, creating inconsistent acceleration or rotation and making the system difficult to control. Therefore, a need exists for a hydraulic system or method for operating a hydraulic system which is configured to accommodate the method for controlling the hydraulic components as described above.

Existing systems may provide for hydraulic swing systems and methods to increase controllability and reduce risks of damage due to inconsistencies within a hydraulic system. One such system is described in U.S. Pat. No. 8,192,175 to Onno et al. (hereinafter "the '175 patent"). The '175 patent provides for a time evolvement function such that successive pumping/motoring strokes are spaced in such a way that fluid output flow may be smoothed to high pressure fluid connections. For example, the working cylinders may be out-of-phase to one another such that the output of the cylinders may maintain the required pressure demand without introducing pulses of high pressure which may occur if all the working cylinders were operating within phase of one another.

Although the '175 patent describes a method and system for operating a hydraulic system as to reduce inconsistencies with the flow of hydraulic fluid, the '175 merely discusses a method of operation wherein a high amount of pressure must be maintained, and operating pumps out-of-phase provides for a continuous pressure to be maintained without straining or introducing too much variation. However, the '175 patent does not discuss a method or system for operating the pumps to incrementally raise the flowrate or pressure within the hydraulic system to provide for a smoother ramp up.

Examples of the present disclosure are directed to overcoming deficiencies of such systems.

SUMMARY

In one aspect of the present disclosure, a hydraulic swing system including: a first hydraulic pump driven by at least one motive device; a second hydraulic pump driven by the at least one motive device and in fluid communication with the first hydraulic pump; a first hydraulic motor configured to drive rotation of the hydraulic swing system; a first hydraulic path fluidly connecting the first hydraulic pump and the second hydraulic pump to the first hydraulic motor; a controller configured to increase a rate of rotation of the hydraulic swing system in a first direction by: engaging the first hydraulic pump to provide a hydraulic fluid through the first hydraulic path to the first hydraulic motor to drive rotation of the hydraulic swing system; and engaging the second hydraulic pump to provide hydraulic fluid through the first hydraulic path to the first hydraulic motor to drive rotation of the hydraulic swing system.

In another aspect of the present disclosure, a hydraulic swing system including a first hydraulic pump driven by at least one motive device; a second hydraulic pump driven by the at least one motive device and in fluid communication with the first hydraulic pump; a first hydraulic motor configured to drive rotation of the hydraulic swing system; a first hydraulic path fluidly connecting the first hydraulic pump and the second hydraulic pump to the first hydraulic motor; a controller configured to increase a flowrate of a hydraulic fluid within the first hydraulic path by: engaging the first hydraulic pump to provide a hydraulic fluid through the first hydraulic path in the first direction to the first hydraulic motor; and engaging the second hydraulic pump to provide hydraulic fluid through the first hydraulic path in the first direction to the first hydraulic motor.

In yet another aspect, a method for controlling a hydraulic swing system including: receiving a first user input into an input device, wherein the first user input is related to a desired rotation of the hydraulic swing system in a first direction; calculating a rate of rotation in the first direction based on the received user input; engaging a first hydraulic pump to provide hydraulic fluid to a first hydraulic motor to achieve the calculated rate of rotation, wherein the first hydraulic motor is configured to drive rotation of the hydraulic swing system; and engaging a second hydraulic pump to provide hydraulic fluid to the first hydraulic motor to achieve the calculated rate of rotation in response to the first hydraulic pump reaching a displacement threshold.

BRIEF DESCRIPTION OF DRAWINGS

The detailed description is set forth with reference to the accompanying figures. In the figures, the left-most digit(s) of a reference number identifies the figure in which the reference number first appears. The use of the same reference numbers in different figures indicates similar or identical items or features.

DETAILED DESCRIPTION possible, the same reference numbers will be used throughout the drawings to refer to same or like parts. In the figures the left-most digit(s) of a reference number identifies the figures in which the reference number first appears.

FIG. 1 depicts an example of a machine 100. A machine 100 can have a substantially rigid frame and may include at least one pump, for example a first pump 102 and a second pump 103 which may each incorporate a swashplate, configured to control the pressure of hydraulic fluid within the machine 100 that may actuate one or more hydraulically controlled components of the machine 100. In the example of FIG. 1, the machine 100 is an excavator with hydraulically-controlled components including a boom 106, a stick 108, and a bucket 110. Though depicted and described herein with respect to the machine 100 as shown being an excavator, other machines such as construction machinery, excavation machinery, stationary equipment, or other such machinery may implement the hydraulic swing system described herein. In particular, the hydraulic swing system is design to minimize the load applied to each component as well as increase the overall control performance of the hydraulic system by applying step-wise controls to the engines and pumps associated with the hydraulic swing system.

Figure 1:
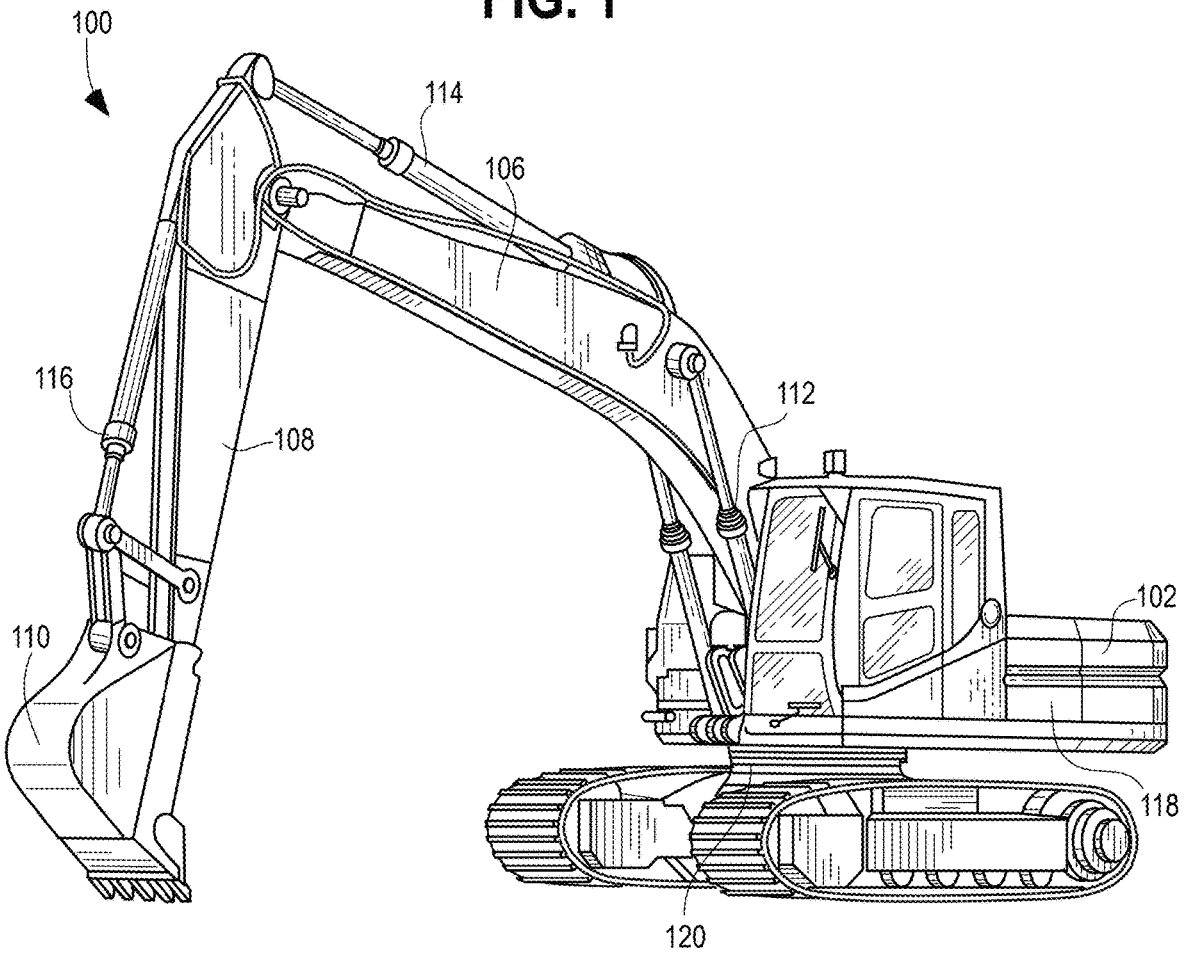
FIG. 1 depicts an example of a machine implementing a hydraulic swing system with a swing pump, in accordance with one or more examples of the present disclosure.
Figure 1:
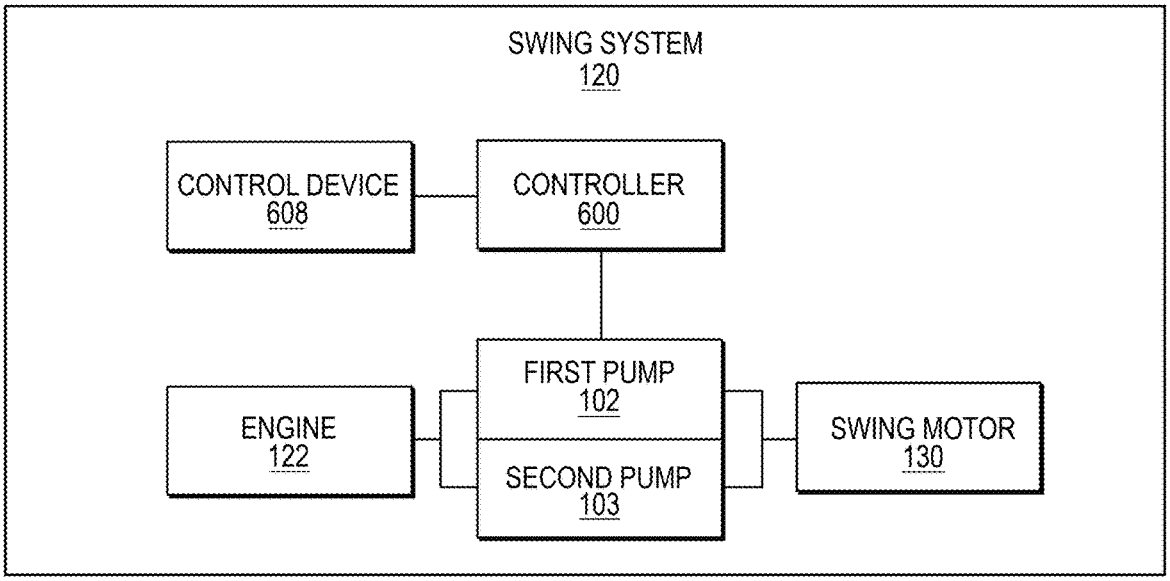

The systems and methods herein provide for increased control accuracy and pump response time during operation of the machine 100. During operation of machinery using traditional hydraulic systems, all of the pumps typically operate in unison which can cause the machine 100 to begin initial acceleration and deceleration in an unpredictable and uncontrollable way. Furthermore, the traditional system may be vulnerable to over pressurization due to the sudden operation of each of the pumps, leading to unwanted heating, potential damage, and excessive wear and tear on the hydraulic system. In some instances, during the life of the hydraulic swing system 120, each component may experience varying degrees of wear and operating conditions and, therefore, may produce varying amounts of outputs further increasing the unpredictability. The present system reduced the concerns stated above by activating each of the pumps in a step-wise fashion such that the flow of hydraulic fluid may be more uniform and predictable despite a sudden increase in the demand of the hydraulic system or the potential for varying outputs. For example, when the operator is providing an input, a first pump may be activated while the remaining pumps remain idle and, once the first pump hits a particular threshold, the second pump may begin to activate, so on and so forth. Further, the operation method and systems described herein can be easily added to existing and known swing systems.

The rotational movement of the machine 100, e.g., of the upper portion relative to the lower portion or undercarriage, may be directed by a controller 600. The controller 600, generally, may include a control device 608 such as a manipulator or joystick operated by the operated and may translate the inputs into a set of control signals which may direct the hydraulic system as well as the other systems of the machine 100. Furthermore, the machine 100 may include sensor(s) 622 in electrically communication with the controller 600. The sensors(s) 622 may be positioned on or around the machine 100 such that the controller 600 receives data related to the position, status of the components, velocity, acceleration, rate of rotation, or other data related to the machine 100 or the environment around the machine 100. Additional discussion of the controller 600 may be found below and in reference to FIG. 6.

Further, the controller 600 may be a machine control system that may adjust an electric current, such as a solenoid current, which may be provided to various components of the machine 100, such as the pumps. Furthermore, in some instances, the pumps may incorporate at least one swashplate configured to control the volume and direction of the flow of hydraulic fluid through the machine 100. In some examples, the controller 600 may include a processor and non-transitory computer-readable medium having instructions stored thereon that, when executed, causes the processor to perform operations, such as control of each pump, each pump swashplate, or other such controlling operations. The controller 600 can process input data, including operator commands and/or data about the current state of the machine 100, and determine electric currents to be provided to one or more pumps that can cause movement of the hydraulically-controlled components. Additional details regarding the controller 600 is described in further detail below in relation to FIG. 6.

In an example, the machine 100 may be controlled by a controller 600 which is capable of (i) receiving an input from an operator into the swing input manipulator, (ii) converting the input into a set of desired movement control signals, (iii) converting the movement control signals into hydraulic system instructions, and (iv) directing the pumps and engines of the hydraulic system based on the hydraulic system instructions.

As noted previously, the first pump 102 and the second pump 103 may control hydraulic cylinders to actuate movement of one or more of the hydraulically-controlled components. For example, a hydraulic boom cylinder 114 may control movement of the stick 108, and a hydraulic bucket cylinder 116 can control movement of the bucket 110 and/or linkage. In other examples, the machine 100 can by any other type of machine with hydraulically-controlled components, such as a wheel loader with a hydraulically-controlled bucket, or a motor grader with a hydraulically-controlled drawbar, circle, and moldboard (DCM).

In some embodiments, the machine 100 may be at least partially electro-hydraulically controlled, such that an electric current may be applied to each of the pumps 102, 103 to control the position of each swashplate. For example, the swashplate may be positioned as to control the direction and magnitude of flow which, in turn, may correspond to movement of one or more hydraulically-controlled components. In further detail, the controller 600 may apply an electric current to the first pump 102 and/or the second pump 103 such that the movement of the hydraulically fluid results in movement of a boom 106, stick 108, bucket 110, an/or other hydraulically-controlled component in accordance with an operator input.

Furthermore, in some instances, the machine 100 may alternatively be configured such that an electric current applied to the control valve(s) can cause the control valves(s) to open or close by different degrees to different valve displacement positions, in turn causing corresponding movement of one or more hydraulically-controlled components. For example, the control valve(s) may have a valve solenoid, and an electric current provided to the valve solenoid which may be adjusted such that the control valve(s) opens or closes to a valve displacement that results in a corresponding movement of a boom 106, stick 108, bucket 110, an/or other hydraulically-controlled component.

As noted previously, the machine 100 may be controlled using a control device 608 configured to accept or receive a user input. In some instances, the control device 608 is electronically coupled to the controller 600 and may be used to control the movement (i.e., velocity, acceleration, rotation) of the machine 100. In this manner, an input from the operator into the control device 608 may cause motion (i.e., velocity, acceleration, displacement, rotation) in proportion to the input provided by the operator. When the operator wishes to keep the machine 100 stationary or to stop moving, the control device 608 may be returned to a neutral position.

For example, a human operator sitting in a cab of an excavator can move the control device 608, such as a lever or joystick, in the cab, or use another type of control device 608, to input an input command, such as a velocity command for a "stick-in" event to move the stick 108 inward at a velocity desired by the operator. As another example, software implementing an autonomous operator can directly output a velocity command or other input command without physical movement of a lever or other control. Velocity commands or other input commands may correspond to different types of functions, operations, or events, such as "stick-in" events, "stick-out" events, "boom-up" events, "boom-down" events, "bucket-curl" events, "bucket-dump" events, or any other event associated with movement of one or more hydraulically controlled components.

Described herein are systems related to a swing system 120 of the machine 100, though other hydraulic systems may use the systems, methods, and devices described herein. The swing system 120 provides for an upper portion or carriage of the machine 100 to move (e.g., rotate) relative to the base of the machine 100. The swing system 120 provides for swing movement as controlled by the operator via a control lever or other control device, as mentioned above. The control device controls the rotational movement of the upper portion of the machine 100 to the base of the machine 100 undercarriage of the excavator. This rotational movement can be to the left-hand side or to the right-hand side direction.

The machine 100 implements a closed loop swing system wherein the swing system 120 is actuated by at least one swing motor 130, for instance a fixed displacement piston motor, which may include a swing brake system, for instance including a multi-disc brake which is applied via a brake cylinder and spring when no control pressure is present, and at least a first pump 102 and a second pump 103 powered by at least one engine 122 or other motive device (e.g., electrical motor or other such rotational motion source), e.g. a variable displacement piston pump, the displacement of which is controlled indirectly by the control device 608. The hydraulic fluid is driven by the at least one pump 102 and, via the swashplate may control the direction of hydraulic fluid flowing to the at least one swing motor 130 and thereby controlling the direction of rotation of the upper portion of the machine 100.

To further expand on the interaction of the first pump 102 and the second pump 103 and the at least one swing motor 130, the first pump 102 and the second pump 103 may provide hydraulic fluid to the at least one swing motor 130 in concert, independently, or sequentially. In some instances, user movement of the control device 608 may be erratic, inconsistent, or sudden and, if transmitted by the controller 600 to the first pump 102 and the second pump 103 directly may be uncontrollable or increase the risk of damage to the hydraulic swing system 120 or the components of the machine 100. For example, if a user quickly interacts with the control device 608, the required hydraulic fluid required by the at least one swing motor 130 to move the machine 100 accordingly may be large.

In such an instance, the first swing pump 102 and the second swing pump 103 may be required to quickly increase the flow of the hydraulic fluid, creating a sharp increase in pressurization of the system and a subsequent rapid or erratic movement, increasing the risk for damage and reducing the controllability of the machine 100. Therefore, in some embodiments, the controller 600 may engage the first pump 102 in response to an operator input to begin providing hydraulic fluid to the at least one swing motor 130, while maintaining the second pump 103 in an idle position. As the first pump 102 begins to raise a flowrate of hydraulic fluid, the displacement of the first pump 102 may be monitored by the controller 600. Once the displacement of the first pump 102 reaches a chosen displacement threshold, the controller 600 may then engage the second pump 103 to raise and/or maintain a consistent flowrate of hydraulic fluid. The sequential engagement of the first pump 102 and the second pump 103 may maintain a consistent and predictable flowrate of hydraulic fluid to ultimately match the operator's interaction with the control device 608, reducing the risk for sudden increases or decreases in response to an operator's input. Therefore, reducing the flowrate risk of over pressurization of the system and increasing the controllability of the machine 100.

As mentioned above, the second pump 103 may be engaged once the first pump 102 hits a chosen displacement threshold. In some instances, the displacement threshold may be chosen or selected based on a variety of factors including the application, age of the components of the machine 100, the type of machine 100, the pump response time of the first pump 102 and the second pump 103, or the calculated flowrate. For example, the displacement threshold may be set at any number between 1 percent and 99 percent, including, but not limited to, 10 percent, 20 percent, 30 percent, 40 percent, 50 percent, 60 percent, 70 percent, 80 percent, or 90 percent. Additionally, the displacement threshold may be dynamic as the application or condition of the hydraulic swing system 120 changes. In some instances, the machine 100 may be configured such that the displacement threshold may be selected such that a consistent flowrate may be produced by the first pump 102 and the second pump 103 throughout the operation of the machine 100. For example, the upstroke and downstroke time (i.e., pump response time) of the first pump 102 and the second pump 103 may be assessed such that a displacement threshold for each pump 102, 103 may be chosen to ensure that a smooth transition may be maintained between the first pump 102 and the second pump 103.

Figure 2:
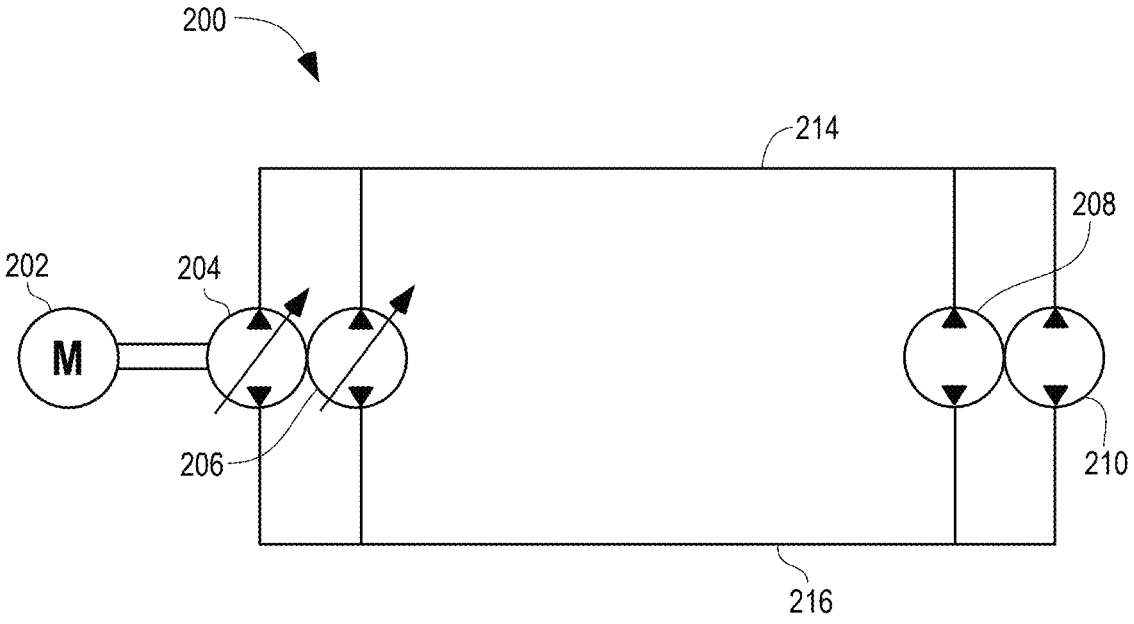
FIG. 2 depicts a schematic of a hydraulic swing system for the machine of FIG. 1, in accordance with one or more examples of the present disclosure.

Referring now to FIG. 2 which depicts a schematic of a hydraulic swing system 200 for the machine 100 of FIG. 1, according to at least one example. Though the hydraulic swing system 200 is depicted with one engine, two pumps, and two motors, the swing system of the machine 100 may include any number of engines, pumps, and motors, and any additional corresponding components as shown and described herein. For example, components described in relation to hydraulic swing system 120 as discussed above may be readily incorporated into the hydraulic swing system 200.

The hydraulic swing system 200 includes an engine 202 or other motive systems that may be configured to provide a rotational input into a first pump 204 and a second pump 206. As noted previously, the engine 202 provides for rotation of the first pump 204 and the second pump 206 such that either may pump hydraulic fluid to a first swing motor 208 and a second swing motor 210. The first swing motor 208 and the second swing motor 210 provides a force to the swing system for rotation of the upper portion of the machine 100 relative to the undercarriage of the machine. Accordingly, the first pump 204 and the second pump 206 are fluidly connected to the first swing motor 208 and the second swing motor 210 through hydraulic fluid paths providing at least a first hydraulic path 214 and a second hydraulic path 216. The first hydraulic path 214 extending from the first pump 204 and the second pump 206 in a first direction and the second hydraulic path 216 extending from the first swing motor 208 and the second swing motor 210 in a second direction opposite the first direction.

The hydraulic swing system 200 is depicted as a closed loop system wherein the first pump 204 and the second pump 206 and the first swing motor 208 and the second swing motor 210 are in communication through the aforementioned first hydraulic path 214 and the second hydraulic path 216. The first pump 204 and the second pump 206 may include a variable displacement piston pump or other such suitable pump, the displacement of which is controlled by a control input from an operator. The hydraulic fluid is driven by both the first pump 204 and the second pump 206 in concert or individually and, via each swashplate, may be directed towards the first swing motor 208 and/or the second swing motor 210 in a first direction or a second direction along the first hydraulic path 214 and the second hydraulic path 216, with the direction based on the desired rotation direction of either the first swing motor 208 or the second swing motor 210. In other words, the swashplate of each of the first pump 102 and/or second pump 103 may be controlled using the aforementioned controller 600 in response to the operator input, for example, based on the direction and magnitude of input to the control device 608 by the operator.

In some instances, the swashplate of each of the first pump 102 and/or the second pump 103 may be configured to selectively move between a first position and a second position. In further detail, the swashplates may control the direction and magnitude of the flow of hydraulic fluid through along either the first hydraulic path 214 or the second hydraulic path 216 based on the desired rotation direction of the first swing motor 208 and the second swing motor 210. Since the hydraulic swing system 200 is a closed-loop, to rotate either the first swing motor 208 or the second swing motor 210 to rotate in a first direction the swashplate of each of the first pump 102 and/or second pump 103 may work in unison to provide the hydraulic fluid to the first swing motor 208 and/or the second swing motor 210 along the first hydraulic path 214 and provide for hydraulic fluid to flow away from the first swing motor 208 and/or the second swing motor 210 along the second hydraulic path 216. For the first swing motor 208 and the second swing motor 210 to operate in the second, opposite direction, the flow controlled by the first pump 102 and the second pump 103 may be reversed. As noted previously, in some embodiments, a series of control valves may be positioned along the first hydraulic path and the second hydraulic path. Each of the control valves may be selectively open and closed based on the desired rotation direction of either the first swing motor 208 or the second swing motor 210.

As noted above, the first pump 204 and the second pump 206 may be engaged sequentially to gradually or incrementally increase the movement of hydraulic fluid throughout the hydraulic swing system 200. In some embodiments, the engine 202 may initially be engaged by the controller 600 in response to an operator input into the control device 608 as to engage the first pump 204 to begin providing hydraulic fluid to the first swing motor 208 and the second swing motor 210 via the first hydraulic path 214. The first pump 204 may operate independently until a particular displacement threshold is achieved, at which, the controller 600 may direct the engine 202 to engage the second pump 206 to begin providing additional hydraulic fluid, alongside the first pump 204, to the first swing motor 208 and the second swing motor 210. The incremental engagement of the first pump 204 and the second pump 206 may gradually increase or maintain the flowrate of the hydraulic fluid to the first swing motor 208 and the second swing motor 210 reducing the risk of unexpected flowrate and pressure variation within the hydraulic system 200 and, subsequently, reduces the risk of over pressurization of the system, increases the controllability of the first swing motor 208 and the second swing motor 210 for the operator, and reduces the risk of the engine 202 being overloaded and/or overheating.

The displacement threshold may be chosen or selected based on a variety of factors including the application, age of the components of the machine 100, the type of machine 100, the pump response time of the pumps, or the calculated flowrate. For example, the displacement threshold may be set at any number between 1 percent and 99 percent, including, but not limited to, 10 percent, 20 percent, 30 percent, 40 percent, 50 percent, 60 percent, 70 percent, 80 percent, or 90 percent. Additionally, the displacement threshold may be dynamic as the application or condition of the hydraulic swing system 120 changes. Furthermore and as noted previously, the machine 100 may be configured such that the displacement threshold may be selected such that a consistent flowrate may be produced by pumps throughout the operation of the machine 100. For example, the upstroke and downstroke time (i.e., pump response time) of each pump may be assessed such that a displacement threshold may be set that ensures a smooth transition between each of the pumps.

Figure 3:
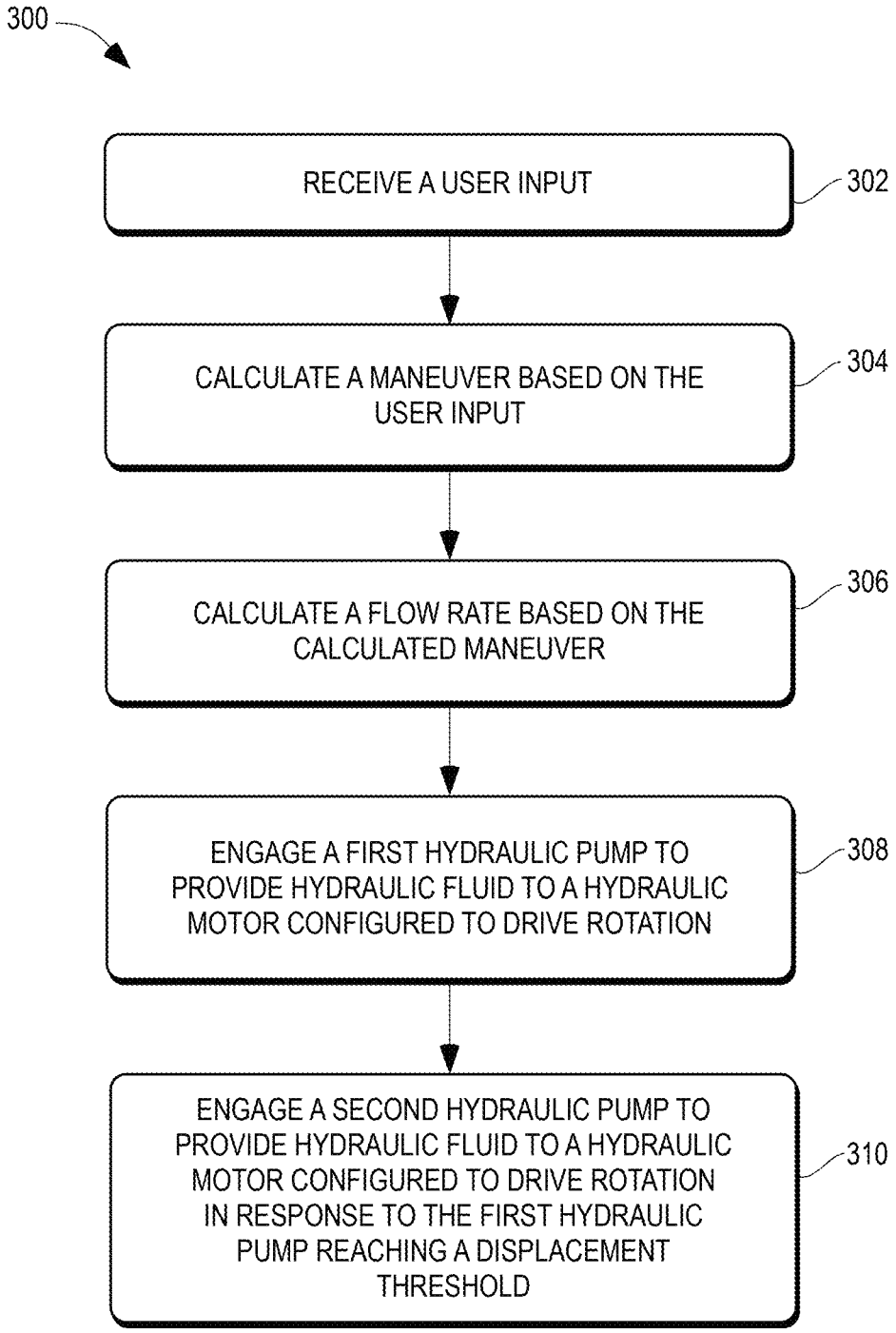
FIG. 3 depicts a method for operating a hydraulic swing system for the machine of FIG. 1, in accordance with one or more examples of the present disclosure.

Referring now to FIG. 3, which depicts a method 300 for controlling a hydraulic swing system 200 as described in relation to machine 100, in accordance with various examples of the subject matter disclosed herein. The method 300 and other processes described herein are illustrated using exemplary flow graphs, each operation of which may represent a sequence of operations that can be implemented in hardware, software, or a combination thereof. In the context of software, the operations represent computer-executable instructions stored on one or more tangible computer-readable storage media that, when executed by one or more processors, perform the recited operations. Generally, computer-executable instructions routines, programs, objects, components, data structures, and the like that perform particular functions or implement particular abstract data types. The order in which the operations are described is not intended to be construed as a limitation, and any number of the described operations can be combined in any order and/or in parallel to implement the processes. In some instances, the aforementioned controller 600 may be used to execute the method 300 described herein.

The method 300 commences at step 302, where a user input is received by a control device 608. As discussed above, the machine 100, more particularly, the hydraulic system 200 may be controlled using a control device 608 electronically coupled to or in electrical communication with the controller 600. In traditional hydraulic systems, a user input may be used to directly adjust the pressurization of the hydraulic system in order to control the swing motors and, ultimately, control the machine 100. However, in the embodiments described herein and as discussed previously, a user's input may be used to adjust the velocity of the components directly instead. For example, a user may input both a direction and magnitude of a desired movement, such as a rotation or displacement of a component of the machine 100.

In some instances, the control device 608 may include any control devices known in the art for interacting with or controlling hydraulic systems. For example, the control device 608 may include a joystick, buttons, foot pedals, or keyboards. Furthermore, the control device 608 may include a touch-sensitive display or a keyboard which may be a standard push button alphanumeric multi-key keyboard (such as a conventional QWERTY keyboard), virtual controls on a touchscreen, or one or more other types of keys or buttons, and may also include a joystick, wheel, and/or designated navigation buttons, or the like. Further, it is envisioned that the control device 608 may incorporate a plurality of control devices 608 such as those described above.

Figure 4:
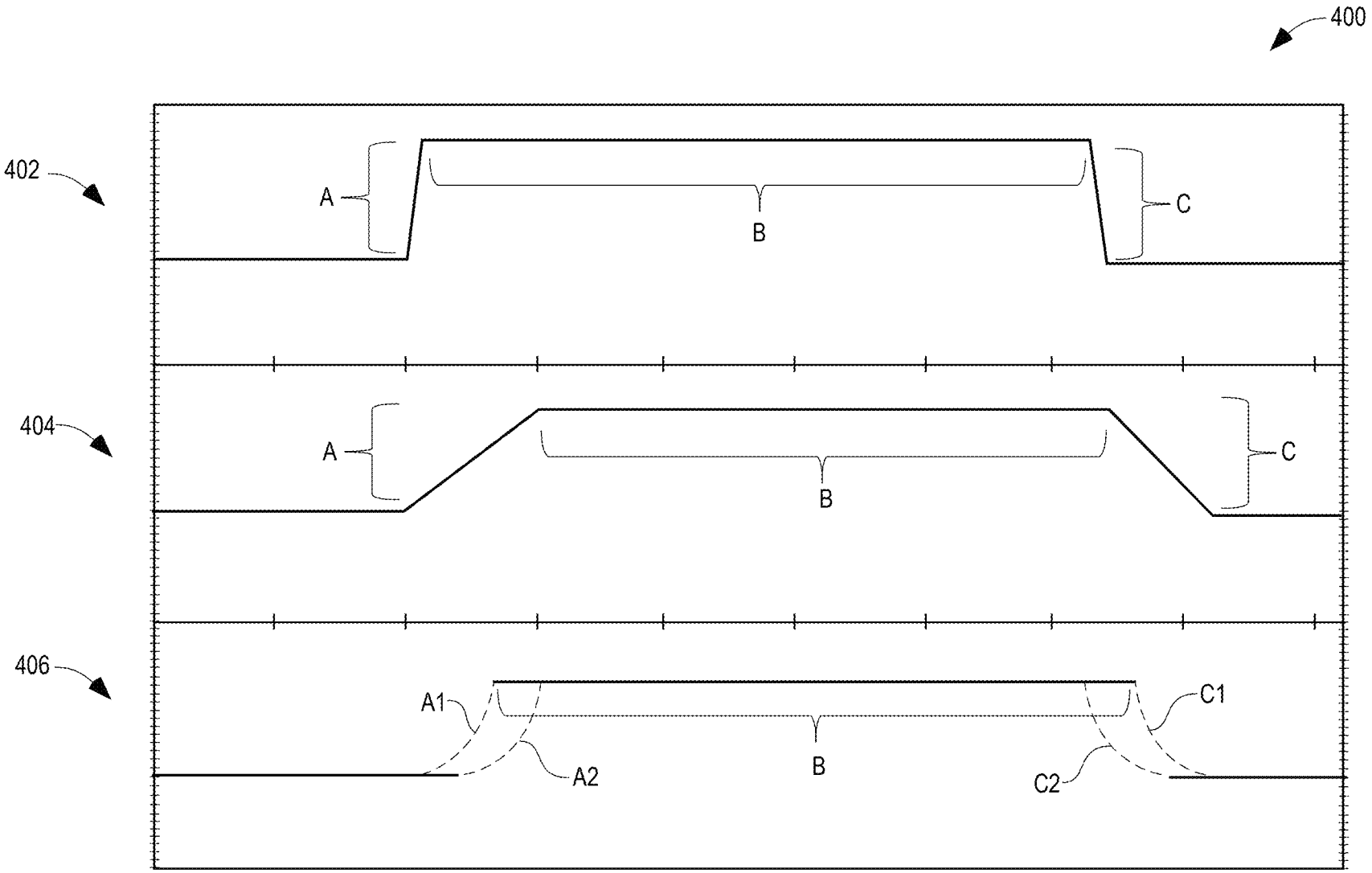
FIG. 4 depicts an exemplary chart related to the execution of the method of FIG. 3, in accordance with one or more examples of the present disclosure.

Referring now to FIG. 4, which depicts a series of exemplary charts which show data related to an exemplary operation 400 of method 300. First, an exemplary series of user inputs over a period of time is depicted by exemplary chart 402. As shown, the user input into the control device 608 is neutral before indicating an increase in magnitude in a first direction being inputted by a user. The initial input is indicated by slope A. Following the initial input, the user continues to input a consistent magnitude and direction, as indicated by line B. Lastly, the user input reduced the magnitude of the input, as indicated by slope C.

The method 300 continues at step 304, where a maneuver is calculated based on the user input. For example, the maneuver may represent a change in the rate of rotation of the upper portion of the machine 100 relative to the lower portion of the machine 100 or an increase or decrease in the acceleration of various components of the machine 100 may be calculated based on the received user input of step 302. In further detail, to prepare commands that may be communicated to the hydraulic swing system 200 via the controller 600, the user inputs, namely the magnitude and direction received by the control device 608, may be used to generate or calculate a maneuver. Furthermore, in some instances, a user's inputs may be sporadic, sudden, or inconsistent, and if directly translated to the hydraulic swing system 200 via the controller 600, may lead to a decrease in controllability of the machine 100 and potential damage to the components of the machine 100 due to sudden increase in the flowrate of hydraulic fluid and a subsequent increase in pressure. Therefore, a non-linear or linear profile may be used to calculate the maneuver, therefore, smoothing the user inputs and reducing the risks discussed above.

In some embodiments, an algorithm or modulation map may be used to translate the user's input into a desired velocity. For example, a slight or subtle user input may result in a slower target velocity, while a larger user input may be associated with a higher target velocity. Furthermore, the association between the user input and the target velocity may be non-linear, such that a user may have increased control while making small movements and may be able to make large changes while making large movements. Additionally, the algorithm or modulation map may be used to translate the user's inputs despite the machine 100 already being in motion.

To explain in further detail and in reference to FIG. 4, an exemplary chart 404 depicting a series of calculated maneuvers based on the user inputs is shown. As noted previously, the calculated maneuvers may take the form of a change in the rate of rotation of the upper portion of the machine 100 relative to the lower portion of the machine or an increase or decrease in the acceleration of various components of the machine 100. As depicted, the calculated maneuver initiates in response to the user's inputs which is reflected by the slope A. As noted, the calculated maneuver softens the user's inputs and depicts a gradual increase in a first direction until the magnitude indicated by the user's input is achieved. As the user maintains a consistent magnitude of input, the calculated maneuvers may mirror the user's input, as indicated by line B. Lastly, as the user reduces the magnitude of the input, the calculated maneuver initiates a decrease in magnitude as depicted by slope C. Similarly to slope A, the calculated maneuvers soften the user's inputs, and depicts a gradual decrease in the first direction until the magnitude is returned to a neutral position.

The method 300 continues at step 306, where a flowrate is calculated based on the calculated maneuver of step 304. The calculated flowrate may be configured to translate the calculated maneuver into a flowrate of hydraulic fluid which may be used by the controller 600 to direct the hydraulic swing system 200 to move the components of the machine 100 as indicated by the calculated maneuver. In other words, the controller 600 may use the combination of the engine 202 and the first pump 204 and the second pump to generate a flowrate in a direction which is associated with the calculated maneuver to change the rate of rotation of the upper portion of the machine 100 relative to the lower portion of the machine or an increase or decrease in the acceleration of various components of the machine 100 in accordance with the calculated maneuver and, subsequently, the user's inputs.

As noted previously, an algorithm or modulation map may be used to translate the user's inputs into a desired movement and, in some embodiments, may be used to choose a target flowrate. In further detail, the user's input may additionally be associated with a desired target flowrate to achieve the target velocity. For example, for a small user input, a smaller flowrate may be chosen, resulting in a more subtle acceleration or deceleration of the machine 100. Alternatively, a large user input may result in a larger target velocity and a resulting high flowrate may be chosen, resulting in a larger acceleration or deceleration of the machine 100. Similarly to as discussed above, the association between the user input and the flowrate may be non-linear, such that a user may have increased control while making small movements and larger changes in flowrate may be made in response to large user inputs.

Furthermore, the calculated flowrate based on the calculated maneuver of step 304 may be dynamic due to external factors such as inertia. For example, an increased inertia of the machine 100 may require a lesser flowrate within the hydraulic system 200 to achieve the calculated maneuver of the components of the machine 100 and a decreased inertia of the machine 100 may require a greater flowrate within the hydraulic system 200. In other words, the greater the amount of inertia the less flowrate will be required to achieve a maximum pressure within the hydraulic system 200. Therefore, in some embodiments, step 306 may include calculating the inertia of the machine 100 based on the position and weight of various components of the machine 100 as well as whether the machine 100 is currently hauling or repositioning a load. As noted above, a plurality of sensors 622 may be positioned on, within, or around the machine 100 which may gather information related to the machine 100 such as velocity, position of components of the machine 100, acceleration, rate of rotation, loads on the components of the machine, flowrates, etc. The controller 600 may be configured to use the sensor 622 data to assist in calculating the inertia of the machine 100 and, subsequently, adjusting the desired flowrate of the hydraulic system 200 to accommodate. In further detail, depending on the inertia of the machine 100, the desired pressure of the hydraulic system 200 may require a higher or lower output of each of the pumps compared to what would be expected or calculated in steps 304 and 306. Therefore, step 306 may further include adjusting the desired flowrate based on variation in inertia in order to maintain accurate and consistent control of the machine 100.

The method 300 continues at step 308 and 310, where the controller 600 may engage the first pump 204, at step 308, and the second pump, at step 310, to provide hydraulic fluid to the first hydraulic motor 208 and the second hydraulic motor 210. As discussed above, the controller 600 may engage or disengage the first pump 204 and the second pump 206 sequentially to increase the controllability of the hydraulic swing system 200 while reducing the risk for damage to the hydraulic swing system 200 due to over pressurization. For example, once the first pump 204 hits a certain displacement threshold, the second pump 206 may be engaged, increasing the flowrate of the hydraulic fluid within the hydraulic swing system towards the calculated flowrate incrementally instead of rapidly. For example, step 308 may engage the first pump 204 to begin raising the flowrate of the hydraulic fluid and, once the first pump 204 reaches a chosen displacement threshold, the method may continue to step 310 to engage the second pump 206 to further raise the flowrate of the hydraulic fluid within the hydraulic swing system 200 to achieve the calculated flowrate of step 306. Furthermore, it is envisioned within the scope of this disclosure, that the total output displacement of each pump may be the same or different depending on the user input at different points based on the position along the acceleration, deceleration, or velocity associated with the user input.

The displacement threshold may be chosen or selected based on a variety of factors including the application, age of the components of the machine 100, the type of machine 100, or the calculated flowrate. For example, the displacement threshold may be set at any number between 1 percent and 99 percent, including, but not limited to, 10 percent, 20 percent, 30 percent, 40 percent, 50 percent, 60 percent, 70 percent, 80 percent, or 90 percent. Additionally, the displacement threshold may be dynamic as the application or condition of the hydraulic swing system 200 changes.

To provide additional explanation of steps 308 and 310 of method 300, in reference to FIG. 4, a chart 406 depicts an exemplary displacement chart of the first pump 204 and the second pump 206. To explain, as the calculated maneuver begins to slope upwards, the first pump 204 is engaged, increasing a flowrate of the hydraulic fluid within the hydraulic swing system 200 and, subsequently, moving the components of the machine 100 in accordance with the calculated maneuver. The engagement of the first pump 204 is depicted as the curve A1. Once the first pump 204 hits the displacement threshold, the second pump 206 may be engaged, further increasing the flowrate of the hydraulic fluid within the hydraulic swing system 200 until the calculated flowrate associated with the calculated maneuver is achieved. The engagement of the second pump 206 is depicted as the curve A2. Furthermore, as the magnitude of the calculated maneuver begins to decrease, the second pump 206 may initially be engaged decreasing the flowrate of the hydraulic fluid within the hydraulic swing system 200. The engagement is depicted as the curve C2. Once the second pump 206 hits the displacement threshold, the second pump 206 may be engaged, further decreasing the flowrate of the hydraulic fluid within the hydraulic swing system 200. The engagement of the first pump 204 is depicted as the curve C1.

Figure 5:
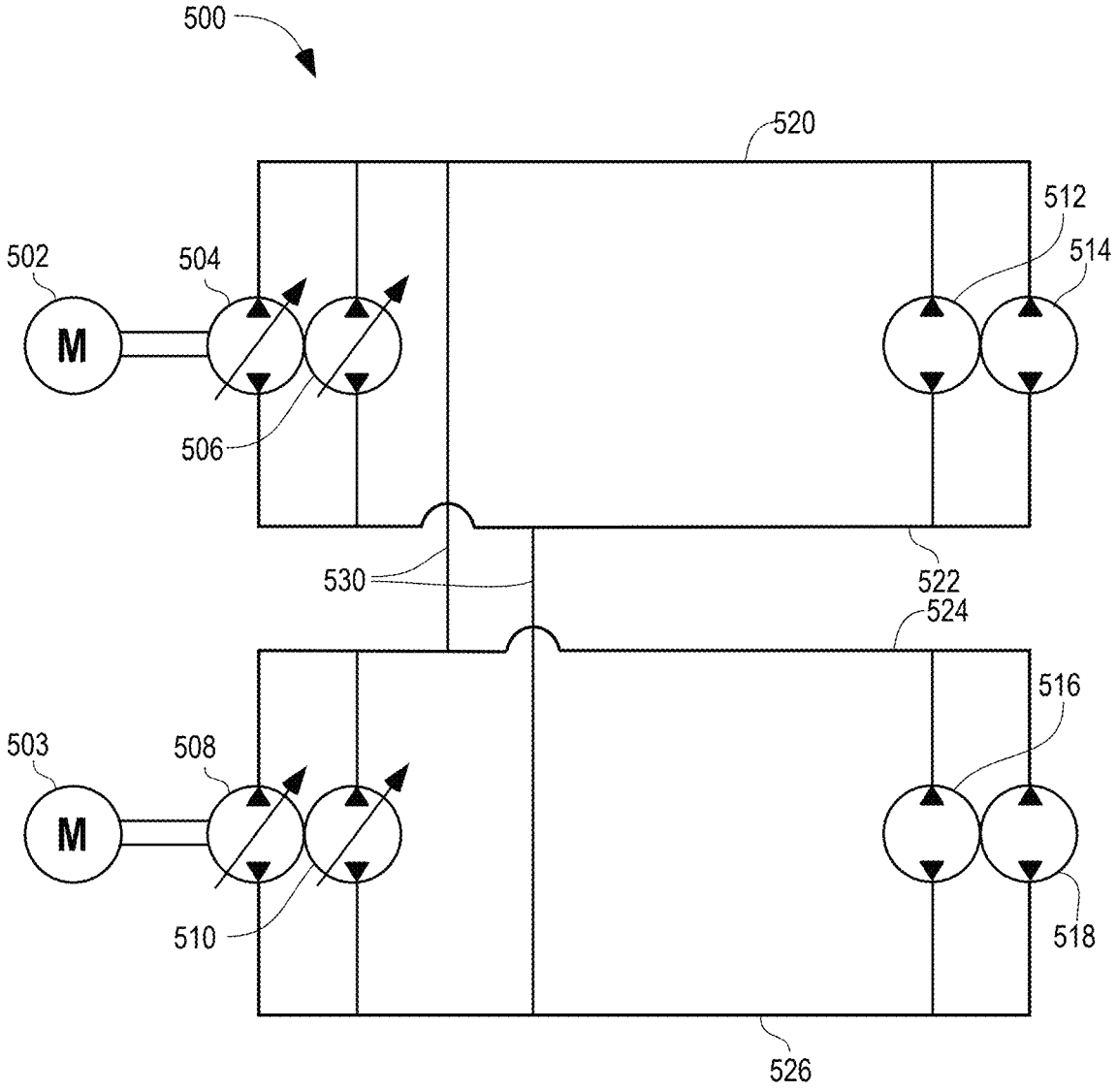
FIG. 5 depicts a second schematic of a hydraulic swing system for the machine of FIG. 1, in accordance with one or more examples of the present disclosure.

Referring now to FIG. 5 which depicts a schematic of a hydraulic swing system 500 for the machine 100 of FIG. 1 according to at least one example. The hydraulic swing system 500 is depicted with a pair of engines, four pumps, and four motors, however, the swing system 500 may include any number of engines, pumps, and motors, and any additional corresponding components as shown and described herein.

As noted above, the hydraulic swing system 500 includes a first engine 502 or other motive systems that may be configured to provide rotational input to a first pump 504 and a second pump 506. Similarly, the second engine 503 or other motive systems may be configured to provide rotational input to a third pump 508 and a fourth pump 510. Similarly to the hydraulic system 200 as described above, the first engine 502 provides for rotation of the first pump 504 and the second pump 506 and the second engine 503 provides for rotation of the third pump 508 and the fourth pump 510. The first pump 504 through fourth pump 510 may pump hydraulic fluid to a first swing motor 512, a second swing motor 514, a third swing motor 516, and a fourth swing motor 518. Each of the swing motors 512-518 may provide a force to the hydraulic swing system for rotation portion of the machine 100 relative to the undercarriage of the machine 100. Still in reference to FIG. 5, a first hydraulic path 520 extends from the first pump 504 and the second pump 506 in a first direction towards the first swing motor 512 and the second swing motor 514 and a second hydraulic path 522 extends away from the first swing motor 512 and the second swing motor 514 in a second direction opposite the first direction. Similarly, a third hydraulic path 524 extends from the third pump 508 and the fourth pump 510 in a first direction towards the third swing motor 516 and the fourth swing motor 518 and a fourth hydraulic path 526 extends away from the third swing motor 516 and the fourth swing motor 518 in a second direction opposite the first direction. Additionally, a pair of bridging lines 530 may couple the first hydraulic path 520 and second hydraulic path 522 to the third hydraulic path 524 and the fourth hydraulic path 526 such that each pump 504-510 may pump hydraulic fluid to each of the swing motors 512-518.

Similarly to discussed with reference to hydraulic system 200, the first pump 504 through fourth pump 510 may include a variable displacement threshold piston pump or other such suitable pump, the displacement threshold of which is controlled by a control input from an operator. The hydraulic fluid may be driven by each of the pumps 504-510 in concert or individually onto the swing motors 512-518 in a first direction or second direction along the first through fourth hydraulic lines 520-526 based on the desired rotation direction of the swing motors 512-518.

As described with reference to system 200 above, each of the first pump 504 through the fourth pump 510 may each incorporate a swashplate that may move between a first position and a second position to control the direction and magnitude of the flowrate of hydraulic fluid. In further detail, the aforementioned controller 600 may control each of the pumps 504-510 in response to the operator input, for example, based on the direction and magnitude of an operator input or in response to the method 300 as described above.

The method 300 may be applied to the system 500 as described above. As noted previously, a user input may be used to calculate a requisite flowrate to move the components of the machine 100 in accordance with the user input. In particular, the calculated flowrate may be implemented by the controller 600 to direct the combination of the first engine 502 and the first pump 504 and the second pump 506 and the second engine 503 and the third pump 508 and the fourth pump 510 to create the calculated flowrate and, subsequently, move the components of the machine 100. Furthermore, the first pump 504, second pump 506, third pump 508, and fourth pump 510 may be engaged sequentially to increase the overall controllability and performance of the hydraulic swing system 120. The sequential engagement will now be discussed in further detail.

The controller 600 may engage the first pump 504 is response to receiving or calculating a desired flowrate and, once, the first pump 504 hits a certain threshold, the second pump 506 may be engaged. Similarly, once the second pump 506 is engaged and reaches a particular threshold, the third pump 508 may engage. Lastly, once the third pump 508 hits a certain threshold, the fourth pump 510 may engage increasing the overall flowrate of the hydraulic system 500 to match the calculated flowrate required to move the components of the machine 100 move in accordance with a user's input. In other words, the first pump 504 may engage, followed by the second pump 506, the third pump 508, and finally the fourth pump 510. To decrease the overall flowrate of the hydraulic swing system 500 of the machine 100, the process may be inversed, instead starting with the fourth pump 510, followed by the third pump 508, the second pump 506, and finally, the first pump 504.

Furthermore, it is envisioned that the order of engagement of the pumps 504-510 may be tailored for a particular use case or application. For example, in order to reduce the wear on either the first engine 502 or the second engine 503, the pump 504-510 engagement order may be altered, instead engaging the third pump 508, followed by the second pump 506, and, finally, the fourth pump 510. In such an instance, the by engaging the first pump 504 and then engaging the third pump 508 when the first pump 504 reached a particular chosen threshold, the first engine 502 may rest while the second engine 503 engages, reducing the risk of damage to the engines due to overheating or overloading. Therefore, it is envisioned, that an operation order of the first pump 504 followed by the third pump 508, the second pump 506, and, finally, the fourth pump 510 may be used in applications wear excessive engine wear may be a concern. Similarly to as described above, to decrease the overall flowrate of the machine 100, the process may be inversed, instead starting with the fourth pump 510, followed by the second pump 506, the third pump 508, and, finally the first pump 504.

The order described in the previous paragraphs is merely exemplary and indicative of potential alterations that may be made to the operation order to tailor the hydraulic systems described herein to various applications. In some embodiments, various operation orders may be used for various amounts of movements. For example, small movements may use a particular order while large movements may use a different order. Furthermore, it is envisioned that with the addition or subtraction of components such as the number of engines, pumps, or swing motors, that additional sequential orders may be implemented to operate the hydraulic system 120. Additionally, and as mentioned previously, the thresholds may be set any number between 1 percent and 99 percent, including, but not limited to, 10 percent, 20 percent, 30 percent, 40 percent, 50 percent, 60 percent, 70 percent, 80 percent, or 90 percent. Further, the threshold may be dynamic and change between each of the pumps, for example the threshold for the second pump 506 to engage may be 50 percent while the threshold for the third pump 508 to engage may be 60 percent.

Figure 6:
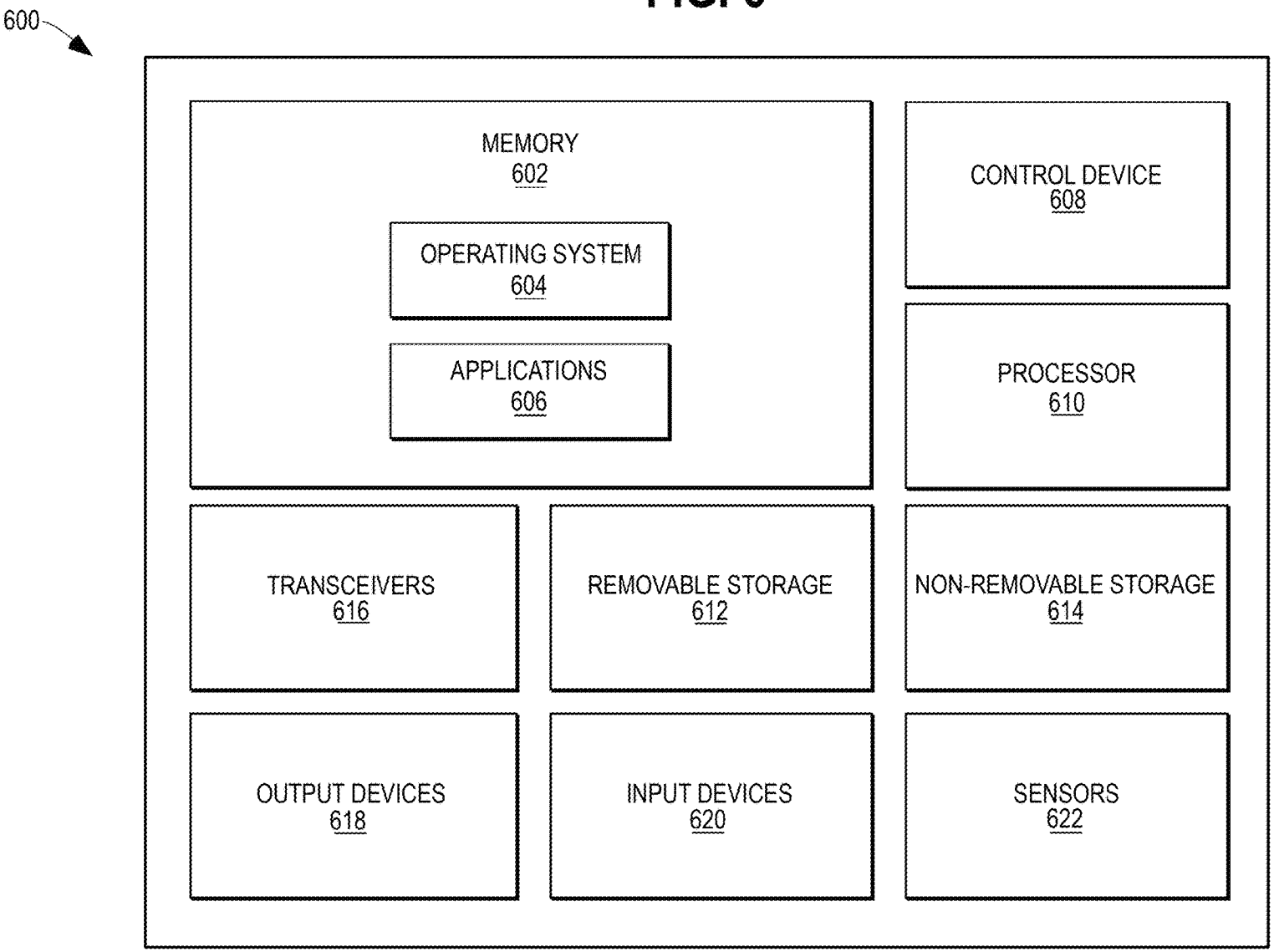
FIG. 6 depicts a component level view of a controller for use with the systems and methods described herein, in accordance with various examples of the presently disclosed subject matter.

Referring now to FIG. 6 which depicts a component level view of the controller 600 for use with the systems and methods described herein, in accordance with various examples of the presently disclosed subject matter. The controller 600 could be any device capable of providing the functionality associated with the systems and methods described herein. The controller 600 can include several components to execute the above-mentioned functions. The controller 600 may be comprised of hardware, software, or various combinations thereof. As discussed below, the controller 600 can comprise memory 602 including an operating system (OS) 604 and one or more standard applications 606. The standard applications 606 may include applications that may create, edit, modify, or delete instructions which may be used to control the hydraulic system 120 as described herein.

The controller 600 can also include one or more processors 610 and one or more of removable storage 612, non-removable storage 614, transceiver(s) 616, output device(s) 618, and input device(s) 620. In various implementations, the memory 602 can be volatile (such as random-access memory (RAM)), non-volatile (such as read only memory (ROM), flash memory, etc.), or some combination of the two. The memory 602 can include data pertaining to the operation of the components of the machine 100 including, but not limited to, the hydraulic swing system 120.

The memory 602 can also include the OS 604. The OS 604 varies depending on the manufacturer of the controller 600. The OS 604 contains the modules and software that support basic functions of the controller 600, such as scheduling tasks, executing applications, and controlling peripherals. The OS 604 can also enable the controller 600 to send and retrieve other data and perform other functions, such as communicating, receiving, or parsing information related to the information gathered by any sensors positioned on the machine 100 as well as any information relating to operation of the hydraulic swing system 120.

The controller 600 can also comprise one or more processors 610. In some implementations, the processor(s) 610 can be one or more central processing units (CPUs), graphics processing units (GPUs), both CPU and GPU, or any other combinations and numbers of processing units. The controller 600 may also include additional data storage devices (removable and/or non-removable) such as, for example, magnetic disks, optical disks, or tape. Such additional storage is illustrated in FIG. 6 by removable storage 612 and non-removable storage 614.

Non-transitory computer-readable media may include volatile and nonvolatile, removable and non-removable tangible, physical media implemented in technology for storage of information, such as computer readable instructions, data structures, program modules, or other data. The memory 602, removable storage 612, and non-removable storage 614 are all examples of non-transitory computer-readable media. Non-transitory computer-readable media include, but are not limited to, RAM, ROM, electronically erasable programmable ROM (EEPROM), flash memory or other memory technology, compact disc ROM (CD-ROM), digital versatile discs (DVD) or other optical storage, magnetic cassettes, magnetic tape, magnetic disk storage or other magnetic storage devices, or any other tangible, physical medium which can be used to store the desired information, which can be accessed by the controller 600. Any such non-transitory computer-readable media may be part of the controller 600 or may be a separate database, databank, remote server, or cloud-based server.

In some implementations, the transceiver(s) 616 include any transceivers known in the art. In some examples, the transceiver(s) 616 can include wireless modem(s) to facilitate wireless connectivity with other components (e.g., between the controller 600 and other possible computer systems), the Internet, and/or an intranet. Specifically, the transceiver(s) 616 can include one or more transceivers that can enable the controller 600 to send or receive information related to the machine 100, including data that may be gathered from the environment, sensors positioned on the machine 100, data from an auxiliary computing system, or external database. Thus, the transceiver(s) 616 can include multiple single-channel transceivers or a multi-frequency, multi-channel transceiver to enable the controller 600 to send and receive video calls, audio calls, messaging, etc. The transceiver(s) 616 can enable the controller 600 to connect to multiple networks including, but not limited to 2G, 3G, 4G, 5G, and Wi-Fi networks. The transceiver(s) 616 can also include one or more transceivers to enable the controller 600 to connect to future (e.g., 6G) networks, Internet-of-Things (IoT), machine-to machine (M2M), and other current and future networks.

The transceiver(s) 616 may also include one or more radio transceivers that perform the function of transmitting and receiving radio frequency communications via an antenna (e.g., Wi-Fi or Bluetooth®). In other examples, the transceiver(s) 616 may include wired communication components, such as a wired modem or Ethernet port, for communicating via one or more wired networks. The transceiver(s) 616 can enable the controller 600 to facilitate audio and video calls, download files, access web applications, and provide other communications associated with the systems and methods, described above.

In some implementations and as discussed above, the output device(s) 618 include any output devices known in the art, such as a display (e.g., a liquid crystal or thin-film transistor (TFT) display), a touchscreen, speakers, a vibrating mechanism, or a tactile feedback mechanism. Thus, the output device(s) can include a screen or display. The output device(s) 618 can also include speakers, or similar devices, to play sounds or ringtones when an audio call or video call is received. Output device(s) 618 can also include ports for one or more peripheral devices, such as headphones, peripheral speakers, or a peripheral display.

In various implementations, input device(s) 620 include any input devices known in the art. For example, the input device(s) 620 may include a camera, a microphone, or a keyboard/keypad. The input device(s) 620 can include a touch-sensitive display or a keyboard to enable users to enter data and make requests and receive responses via web applications (e.g., in a web browser), make audio and video calls, and use the standard applications 606, among other things. A touch-sensitive display or keyboard/keypad may be a standard push button alphanumeric multi-key keyboard (such as a conventional QWERTY keyboard), virtual controls on a touchscreen, or one or more other types of keys or buttons, and may also include a joystick, wheel, and/or designated navigation buttons, or the like. A touch sensitive display can act as both an input device 620 and an output device 618. Additionally, and as mentioned above, the input device 620 and the output device 618 may be combined into a graphical user interface which may be used to execute the methods described herein.

As noted above, a plurality of sensors 622 may be positioned on, within, or around the machine 100. The sensors 622 may gather information related to the machine 100 such as velocity, position of components of the machine 100, acceleration, rate of rotation, loads on the components of the machine, flowrates, etc. Additionally, information related to the environment surround the machine 100 may be received by the sensors 622 including temperature, terrain, weather, etc. Sensors 622 such as, but not limited to, pressure sensors, motion sensors, or force sensors, may be implemented on or within the machine 100. The controller 600 may receive data from the sensors 622 to assist in the execution of the methods or operations of the systems described herein.

Reference was made to the examples illustrated in the drawings, and specific language was used herein to describe the same. It will nevertheless be understood that no limitation of the scope of the technology is thereby intended. Alterations and further modifications of the features illustrated herein, and additional applications of the examples as illustrated herein, which would occur to one skilled in the relevant art and having possession of this disclosure, are to be considered within the scope of the description.

Furthermore, the described features, structures, or characteristics may be combined in any suitable manner in one or more examples. In the preceding description, numerous specific details were provided, such as examples of various configurations to provide a thorough understanding of examples of the described technology. One skilled in the relevant art will recognize, however, that the technology may be practiced without one or more of the specific details, or with other methods, components, devices, etc. In other instances, well-known structures or operations are not shown or described in detail to avoid obscuring aspects of the technology.

Although the subject matter has been described in language specific to structural features, it is to be understood that the subject matter defined in the appended claims is not necessarily limited to the specific features described. Rather, the specific features are disclosed as illustrative forms of implementing the claims.

INDUSTRIAL APPLICABILITY

The present disclosure is related generally to methods and systems for operating a hydraulic swing system for a machine. In some embodiments, the hydraulic swing system 120 may include a combination of an engine 202 and a first pump 204 and a second pump 206 which may provide hydraulic fluid to at least one swing motor to control the movement of the components of the machine 100. Traditional hydraulic swing systems may incorporate a user input to control the overall pressurization of the hydraulic system to control the movement of the machine 100. However, the systems and methods described herein may use a controller 600 to convert a user input into a series of operations and instructions which provide for a user to control the velocity of movement of the machine 100. Such systems and methods may provide for more intuitive, controllable, and efficient operation of the machine 100 as opposed to traditional systems and methods.

Furthermore, the present disclosure is additionally related to methods and systems for sequentially operating the pumps associated with the hydraulic system 120 to improve efficiency of operation, controllability of the movement of the machine, reduce wear and tear on the components of the machine 100, and reduce the risk of damage due to the machine 100 over pressurization. In particular, the hydraulic swing system 120 may include a plurality of engines and/or pumps which may flow hydraulic fluid to at least one swing motor. In traditional embodiments, the plurality of engines and pumps may work simultaneously to increase the pressurization of the hydraulic system 120 to move the machine 100. Simultaneous operation may lead excessive wear and tear on the components and unpredictability and erratic movements due to inconsistent efficiency and operation of the engines, the pumps, and/or the swing motors. In particular, over the course of the life of the hydraulic machine components may begin to age due to operation and may no longer uniformly operate to similar components. Therefore, during operation, the lack of uniformity may lead to unpredictable results and provide undue stress on the machine 100 and additionally reduce the controllability of the movement of the machine 100.

Therefore, methods described herein may include operations and instructions for sequentially operating the pumps of the hydraulic system 120 to reduce the risks described above. For example, operation of a first pump to may be initiated as a result of an input by a user and, once a particular threshold is reached, a second pump may begin operation, and so on for the number of pumps associated with a particular hydraulic swing system. In other words, the sequential operation of the pumps provides for the hydraulic swing system to more predictably provide hydraulic fluid to the swing motors while reducing the risk of inconsistencies of pumps that may exist between each of the pumps. Furthermore, the sequential operation order may be configured based on various applications, for example, to reduce the stress applied to the engines, to reduce the stress applied to the pumps, or to increase the controllability based on the condition of each of the components of the machine 100.

Unless explicitly excluded, the use of the singular to describe a component, structure, or operation does not exclude the use of plural such components, structures, or operations or their equivalents. As used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed:

1. A hydraulic swing system comprising:
- a motive system having at least one motive device;
- a first hydraulic pump driven by the motive system;
- a second hydraulic pump driven by the motive system and in fluid communication with the first hydraulic pump;
- a first hydraulic motor configured to drive rotation of the hydraulic swing system;
- a first hydraulic path fluidly connecting the first hydraulic pump and the second hydraulic pump to the first hydraulic motor;
- a controller configured to increase a rate of rotation of the hydraulic swing system in a first direction by:
  - engaging the first hydraulic pump to provide a hydraulic fluid through the first hydraulic path to the first hydraulic motor to drive rotation of the hydraulic swing system; and
  - in response to the first hydraulic pump reaching a displacement threshold, engaging the second hydraulic pump to provide hydraulic fluid through the first hydraulic path to the first hydraulic motor to drive rotation of the hydraulic swing system.

2. The hydraulic swing system of claim 1, wherein the engaging of the second hydraulic pump causes an increase a rate of rotation of the hydraulic swing system in a first direction.

3. The hydraulic swing system of claim 2, wherein the controller is further configured to increase a rate of rotation of the hydraulic swing system in a second direction by:
- engaging the second hydraulic pump; and
- engaging the first hydraulic pump in response to the second hydraulic pump reaching a displacement threshold,
- wherein the second direction is opposite the first direction.

4. The hydraulic swing system of claim 1 further comprising:
- a third hydraulic pump driven by the motive system;
- a fourth hydraulic pump driven by the motive system and in fluid communication the third hydraulic pump;
- a second hydraulic motor configured to drive rotation of the hydraulic swing system; and a second hydraulic path fluidly connecting the third hydraulic pump and the fourth hydraulic pump to the second hydraulic motor,
- wherein the first hydraulic pump and the second hydraulic pump are in fluid communication with the third hydraulic pump, the fourth hydraulic pump, and the second hydraulic motor.

5. The hydraulic swing system of claim 4, wherein the controller is additionally configured to increase the rate of rotation of the hydraulic swing system in the first direction by:
- engaging the second hydraulic pump in response to the first hydraulic pump reaching a displacement threshold;
- engaging the third hydraulic pump in response to the second hydraulic pump reaching a displacement threshold; and
- engaging the fourth hydraulic pump in response to the first hydraulic pump reaching a displacement threshold.

6. The hydraulic swing system of claim 5, wherein the controller is further configured to increase a rate of rotation of the hydraulic swing system in a second direction by:

engaging the fourth hydraulic pump;

engaging the third hydraulic pump in response to the fourth hydraulic pump reaching a displacement threshold;

engaging the second hydraulic pump in response to the third hydraulic pump reaching a displacement threshold; and engaging the first hydraulic pump in response to the second hydraulic pump reaching a displacement threshold, wherein the second direction is opposite the first direction.

7. The hydraulic swing system of claim 5, wherein the controller is further configured to increase a rate of rotation of the hydraulic swing system in a second direction by:

engaging the fourth hydraulic pump;

engaging the second hydraulic pump in response to the fourth hydraulic pump reaching a displacement threshold;

engaging the third hydraulic pump in response to the second hydraulic pump reaching a displacement threshold; and engaging the first hydraulic pump in response to the third hydraulic pump reaching a displacement threshold, wherein the second direction is opposite the first direction.

8. The hydraulic swing system of claim 4, wherein the controller is additionally configured to increase the rate of rotation of the hydraulic swing system in the first direction by:

engaging the third hydraulic pump in response to the first hydraulic pump reaching a displacement threshold;

engaging the second hydraulic pump in response to the second hydraulic pump reaching a displacement threshold; and engaging the fourth hydraulic pump in response to the first hydraulic pump reaching a displacement threshold.

9. The hydraulic swing system of claim 4, wherein the motive system comprises:

a first engine rotationally coupled to both the first hydraulic pump and the second hydraulic pump; and a second engine rotationally coupled to both the first hydraulic pump and the second hydraulic pump, wherein the controller is further configured to:

engage the first engine to drive the first hydraulic pump and/or to drive the second hydraulic pump; and engage the second engine to drive the third hydraulic pump and/or to drive the fourth hydraulic pump.

10. The hydraulic swing system of claim 9, wherein the first engine is configured to drive the first hydraulic pump and the second hydraulic pump independently from one another, and wherein the second engine is configured to drive the third hydraulic pump and the fourth hydraulic pump independently from one another.

11. The hydraulic swing system of claim 1, wherein the controller is further configured to:

receive a user input from an input device; and calculate a rate of rotation in the first direction based on the received user input; and engage the first hydraulic pump and subsequently the second hydraulic pump until the calculated rate of rotation is achieved.

12. A hydraulic swing system comprising:

a motive system having at least one motive device;

a first hydraulic pump driven by the motive system;

a second hydraulic pump driven by the motive system and in fluid communication with the first hydraulic pump;

a first hydraulic motor configured to drive rotation of the hydraulic swing system;

a first hydraulic path fluidly connecting the first hydraulic pump and the second hydraulic pump to the first hydraulic motor;

a controller configured to increase a flowrate of a hydraulic fluid within the first hydraulic path by:

engaging the first hydraulic pump to provide a hydraulic fluid through the first hydraulic path to the first hydraulic motor; and in response to the first hydraulic pump reaching a displacement threshold, engaging the second hydraulic pump to increase the flowrate of hydraulic fluid through the first hydraulic path to the first hydraulic motor.

13. The hydraulic swing system of claim 12, wherein the controller is further configured to decrease a flowrate of a hydraulic fluid within the first hydraulic path by:

engaging the second hydraulic pump to reduce an amount of hydraulic fluid provided through the first hydraulic path; and engaging the first hydraulic pump to reduce an amount of hydraulic fluid provided through the first hydraulic path in response to the second hydraulic pump reaching a displacement threshold.

14. The hydraulic swing system of claim 12, wherein the controller is further configured to:

receive a user input from an input device;

calculate a rate of rotation in a first direction based on the received user input;

calculate a flowrate of the hydraulic fluid through the first hydraulic path based on the calculated rate of rotation; and engage the first hydraulic pump and subsequently the second hydraulic pump until the calculated flowrate is achieved.

15. A method for controlling a hydraulic swing system comprising:

receiving a first user input into an input device, wherein the first user input is related to a desired rotation of the hydraulic swing system in a first direction;

calculating a rate of rotation in the first direction based on the received first user input;

engaging a first hydraulic pump to provide hydraulic fluid to a first hydraulic motor to achieve the calculated rate of rotation, wherein the first hydraulic motor is configured to drive rotation of the hydraulic swing system; and engaging a second hydraulic pump to provide hydraulic fluid to the first hydraulic motor to achieve the calculated rate of rotation in response to the first hydraulic pump reaching a displacement threshold.

16. The method for controlling a hydraulic swing system of claim 15 further comprising:

engaging a third hydraulic pump to provide hydraulic fluid to a second hydraulic motor to achieve the calculated rate of rotation in response to the second hydraulic pump reaching a displacement threshold, wherein the second hydraulic motor is configured to drive rotation of the hydraulic swing system; and engaging a fourth hydraulic pump to provide hydraulic fluid to the second hydraulic motor to achieve the calculated rate of rotation in response to the third hydraulic pump reaching a displacement threshold.

17. The method for controlling a hydraulic swing system of claim 15, further comprising:

receiving a second user input into the input device, wherein the second user input is related to a desired rotation of the hydraulic swing system in a second direction, wherein the second direction is opposite the first direction;

calculating a second rate of rotation in the second direction based on the received second user input;

engaging the second hydraulic pump to provide hydraulic fluid to a first hydraulic motor to achieve the calculated rate of rotation; and engaging the first hydraulic pump to provide hydraulic fluid to the first hydraulic motor to achieve the calculated rate of rotation in response to the second hydraulic pump reaching a displacement threshold.

18. The method for controlling a hydraulic swing system of claim 15 further comprising calculating a desired pressure of the hydraulic fluid within the first hydraulic motor based on the calculated rate of rotation.

19. The method for controlling a hydraulic swing system of claim 15, wherein engaging the first hydraulic pump and the second hydraulic pump increases a flowrate of the hydraulic fluid to the first hydraulic motor.

* * * * *